US012352139B2

(12) United States Patent
McKay et al.

(10) Patent No.: US 12,352,139 B2
(45) Date of Patent: Jul. 8, 2025

(54) SCREEN APPARATUS AND METHOD

(71) Applicant: Swellfix UK Limited, Westhill (GB)

(72) Inventors: Eilidh Jean McKay, Aberdeen (GB); Duncan Alexander Harper, Alford (GB)

(73) Assignee: Swellfix UK Limited, Aberdeenshire (GB)

( * ) Notice: Subject to any disclaimer, the term of this patent is extended or adjusted under 35 U.S.C. 154(b) by 56 days.

(21) Appl. No.: 17/631,109

(22) PCT Filed: Aug. 12, 2020

(86) PCT No.: PCT/EP2020/072633

§ 371 (c)(1),
(2) Date: Jan. 28, 2022

(87) PCT Pub. No.: WO2021/028474

PCT Pub. Date: Feb. 18, 2021

(65) Prior Publication Data

US 2022/0220832 A1 Jul. 14, 2022

(30) Foreign Application Priority Data

Aug. 12, 2019 (GB) ..... 1911536.9

(51) Int. Cl.
*E21B 43/10* (2006.01)
*E21B 34/14* (2006.01)

(52) U.S. Cl.
CPC ..... *E21B 43/108* (2013.01); *E21B 34/14* (2013.01)

(58) Field of Classification Search
CPC ..... E21B 43/108; E21B 34/14
See application file for complete search history.

(56) References Cited

U.S. PATENT DOCUMENTS 4,589,482 A * 5/1986 Bayh, III ..... E21B 34/105 166/321
6,543,545 B1 4/2003 Chatterji et al.
(Continued)

FOREIGN PATENT DOCUMENTS

GB 2115040 A 9/1983
WO 2004/099560 A1 11/2004

OTHER PUBLICATIONS

International Preliminary Report on Patentability for PCT/EP2020/072633 dated Feb. 24, 2022.
(Continued)

*Primary Examiner* — Dany E Akakpo
(74) *Attorney, Agent, or Firm* — Harness, Dickey & Pierce, P.L.C.

(57) ABSTRACT

A downhole expandable apparatus for restricting ingress of solids in a wellbore comprises a base pipe, a fluid permeable expandable foam material mounted on the base pipe configurable between a non-expanded and an expanded configuration, and a retractable sleeve. The retractable sleeve is moveable between a first configuration in which the retractable sleeve retains the expandable foam material in the non-expanded configuration, and a second configuration in which the retractable sleeve is retracted to provide a free portion of the expandable foam material. The expandable foam material is permitted to radially expand towards the expanded configuration and into engagement with a surface in the wellbore.

20 Claims, 5 Drawing Sheets

(56) References Cited

U.S. PATENT DOCUMENTS

| | | | | |
|---|---|---|---|---|
| 7,048,048 | B2 | 5/2006 | Nguyen et al. | |
| 2004/0261994 | A1* | 12/2004 | Nguyen | E21B 43/103 166/227 |
| 2008/0099206 | A1 | 5/2008 | van Batenburg et al. | |
| 2013/0292117 | A1 | 11/2013 | Robisson et al. | |
| 2016/0208578 | A1* | 7/2016 | Guzman | E21B 34/10 |

OTHER PUBLICATIONS

GBER for Great Britain Application No. 1911536.9 dated May 11, 2020.
GBER for Great Britain Application No. 1911536.9 dated Oct. 13, 2021.
GBER for Great Britain Application No. 1911536.9 dated Dec. 3, 2020.
GBER for Great Britain Application No. 1911536.9 dated Jun. 25, 2021.
International Search Report and Written Opinion for International Application No. PCT/EP2020/072633 dated Nov. 19, 2020.

* cited by examiner

SCREEN APPARATUS AND METHOD

CROSS-REFERENCE TO RELATED APPLICATIONS

This application is a national phase under 35 U.S.C. § 371 of PCT International Application No. PCT/EP2020/072633 which has an International filing date of Aug. 12, 2020, which claims priority to Great Britain Application No. 1911536.9, filed Aug. 12, 2019, the entire contents of each of which are hereby incorporated by reference.

FIELD

The present disclosure relates to a downhole screen apparatus for setting within a wellbore.

BACKGROUND

Many operations in the oil and gas industry require the use of screens to facilitate certain operations, for example to provide a filter mechanism during production from a subterranean reservoir. For example, it is often desirable in certain geologies to deploy sand screens in a wellbore to prevent or minimise the production of sand with produced fluids.

Sand control mechanisms, such as sand screens, in some instances can fail, most commonly caused by erosion and hot spots. Such failed sand control mechanisms in most cases will require remedial attention to regain sand control integrity. Such remedial action may necessitate complex, time consuming and expensive intervention operations, often requiring multiple trips into and from the well to perform a staged repair process.

Numerous other complexities and issues can arise in downhole operations, such as bore collapse, wellbore debris interfering with downhole equipment such as pumps and the like.

SUMMARY

An aspect of the present disclosure relates to a downhole expandable apparatus for restricting ingress of solids in a wellbore, comprising:

- a base pipe;
- a fluid permeable expandable foam material mounted on the base pipe configurable between a non-expanded and an expanded configuration; and
- a retractable sleeve moveable between a first configuration in which the retractable sleeve retains the expandable foam material in the non-expanded configuration, and a second configuration in which the retractable sleeve is retracted to provide a free portion of the expandable foam material, permitted to radially expand towards the expanded configuration and into engagement with a surface in the wellbore.

The expandable apparatus may be installed in the wellbore, and the retractable sleeve retracted, in use. When the retractable sleeve is retracted and the foam material expanded, the foam material may function to provide a filtration effect within the wellbore. That is, the foam material may permit the passage of fluids (e.g., oil, water, gas etc.) therethrough, while preventing or restricting the passage of solids, such as particulate material, for example sand. The expandable apparatus may have various possible uses. For example, the expandable apparatus may be used to prevent the incursion of sand through an aperture in a pipe, tubular, casing, screen or the like during production or injection operations. In another example, the expandable apparatus may prevent the release of debris (e.g. sand, rock, shale or the like) from a formation and into a wellbore.

The apparatus may thus comprise a filter assembly at least partially formed by the fluid permeable expandable foam material. In this example the apparatus may be defined as a downhole filtration apparatus.

When the retractable sleeve is retracted, at least a portion (e.g. some or all of) the foam material may expand. The expansion may be, at least in part, by virtue of an elastic recovery effect of the foam material, as a result of swelling of the foam material, as a result of decompression of the foam material, or the like, or a combination of any such effects. The foam material may expand into an annulus region between the base pipe and the wall of the wellbore and may, for example, fill at least a part of the annulus such that the expanded foam material is pressed against a surface in the wellbore for example the rock face of the wellbore itself where the expandable apparatus is installed in an open-hole section of the wellbore, or the surface of a casing, liner, pipe, sand screen or the like where the apparatus is installed in a cased/lined section of the wellbore. As the foam material is permeable to fluids, fluid flow through the foam and towards (and away from) the base pipe is permitted, while solids are restricted from progression towards the base pipe. Where the expandable foam is in contact with the surface of a casing, liner, pipe or the like then any apertures, cracks or other defects therein that are bridged and/or plugged by the foam material will continue to permit the flow of fluids therethrough, while the flow of solid matter is prevented. In this way, the foam effectively excludes any particulate matter from a flow of fluid therethrough.

In use, the apparatus may be set in a wellbore adjacent a known defect, for example a known defect in casing, liner, sand screen or the like. The apparatus may be set as a part of a retrofit or remedial operation, for example as a retrofit apparatus, or the apparatus may be run in a completion string, for example. Such a defect may be problematic as, for example, it may allow the ingress of particulates such as sand into the casing, liner, sand screen etc. Once positioned, a portion of the expandable foam material may be configured to the expanded configuration so as to bridge the defect, by the retraction of the retractable sleeve. The expanded portion of the expandable foam material may refer to the entirety of the expandable foam material, although not necessarily. In some examples, the expanded portion may refer to a part of the expandable foam material, with a separate part thereof remaining in the non-expanded configuration. Installing the apparatus in a wellbore may enable a user to mitigate the effects of a failed sand screen by running the apparatus into the wellbore in a single trip. As such, the apparatus may provide cost benefits to the user, as it may enable remedial action to be taken quickly, and without the requirement of a staged intervention process involving multiple trips into a wellbore.

The retractable sleeve may subsequently be able to be moved from the second configuration, and back to the first configuration, which may additionally configure the expandable foam material from the expanded configuration to the non-expanded configuration. With the retractable sleeve in the first configuration, the expandable apparatus may be able to be more easily retrieved from a wellbore The expandable apparatus may permit the production and/or injection of a fluid into a wellbore. The expandable apparatus may facilitate the production of hydrocarbons from the wellbore. For example, the base pipe of the expandable apparatus may directly transport hydrocarbons from the wellbore. Additionally or alternatively, the base pipe may transport non-hydrocarbon wellbore fluids (e.g. water) from the wellbore so as to additionally allow hydrocarbons to be produced from the wellbore, although which may not be produced directly in the base pipe.

The expandable apparatus may be used to remove particulate matter from a wellbore. The expandable apparatus may permit injection of a fluid (e.g. water) into a wellbore for the purpose of creating fractures in the surrounding formation, or to encourage hydrocarbon production in a neighbouring wellbore. The expandable apparatus may permit injection of fluid (e.g. water) into a wellbore for the purpose of particulate removal from the wellbore. For example, the expandable apparatus may permit the injection of a fluid into the exterior of a casing in the wellbore so as to cause turbulent flow inside the wellbore (e.g. the casing). The turbulent flow may disturb particulate matter (e.g. sand) that has settled in the wellbore and/or casing (for example, as a result of particulate ingress through an aperture in the casing) so as to suspend the particulate matter in the injected fluid. Thereafter, the expandable apparatus may be used to circulate out the injected fluid from the wellbore, thereby reducing the volume of particulate matter present in a section of the wellbore. As such, the expandable apparatus may permit the preparation of a section of the wellbore prior to installation of the apparatus in the wellbore.

The apparatus may comprise a flow channel extending axially along the length of the apparatus. The flow channel may permit a fluid flow therethrough. The flow channel may be defined by the base pipe of the apparatus.

The base pipe may comprise a single component. Alternatively, the base pipe may comprise a plurality of components that are secured together to form the base pipe. Each of the plurality of components may provide the expandable apparatus with an additional function.

The base pipe may comprise an aperture in a wall thereof. The base pipe may comprise a plurality of apertures located in a wall thereof. The aperture, or plurality of apertures, may assist in the production and/or injection of a fluid using the expandable apparatus. The aperture, or plurality of apertures, may be located on the base pipe to facilitate production and/or injection through the base pipe. For example, the plurality of apertures may be axially spaced along the base pipe, for example evenly axially spaced, such as substantially evenly axially spaced. The plurality of aperatures may be circumferentially spaced along the base pipe, for example evenly circumferentially spaced, such as substantially evenly circumferentially spaced. Alternatively, there may be an accumulation of apertures located at a particular location of the base pipe, for example towards an axially central portion of the base pipe, or an axial end of the base pipe, and/or may be restricted to a circumferential segment, such as a single side of the base pipe. The aperture, or at least one of the plurality of apertures, may comprise a valve therein, for example a one-way check valve. In one example, all of the plurality of apertures may comprise a valve therein. Having a plurality of apertures may assist to permit the expandable apparatus to be used efficiently in the injection and/or production of a fluid in the wellbore.

The aperture, or at least one of the plurality of apertures, may be positioned axially in line with a section of the expandable foam material. The aperture, or at least one of the plurality of apertures may be positioned on a section of the base pipe onto which the expandable foam material is mounted. In one example, all of the plurality of apertures may be positioned on the section of the base pipe onto which the expandable foam material is mounted. As such, the aperture, or the plurality of apertures, may be positioned on the base pipe, under the expandable foam material. The expandable foam material may extend across at least one (or some or all) of the plurality of apertures (e.g. the expandable foam material may cover one (or some or all) of the plurality of apertures). A fluid may be able to be flowed through the foam material and through at least one of (e.g. each of) the plurality of apertures, and into an interior of the base pipe (e.g. into the flow channel, for example during production of hydrocarbons) such that communication to/from an interior of the base pipe (e.g. the flow channel) is via the expandable foam material. A fluid may be able to be flowed from the interior of the base pipe (e.g. from the flow channel), through the aperture or at least one of (e.g. each of) the plurality of apertures and through the expandable foam material (e.g. from the flow channel, for example during injection) such that communication to/from an interior of the base pipe (e.g. the flow channel) is via the expandable foam material. Such positioning of the plurality of apertures may prevent, or restrict, particulate matter from the formation adjacent the wellbore from flowing through at least one of, or all of, the plurality of apertures in the base pipe.

The expandable apparatus may comprise a flow port for the introduction and/or removal of a fluid from the wellbore. The expandable apparatus may comprise a nozzle or jet. The nozzle or jet may be located in the flow port. The nozzle or jet may assist in causing turbulent flow in the wellbore, e.g. for the purposes of preparing the apparatus for installation therein by removing particulate matter from the wellbore, such as sand. The nozzle or jet may direct a flow of fluid from the flow channel and into the wellbore. For example, a flow of fluid may be injected into the wellbore to suspend particulate matter in the wellbore in the flow of fluid. Subsequently, the flow of fluid may be circulated towards the surface of the wellbore, for example circulated towards the surface of the wellbore via an annulus, such as an annulus between the expandable apparatus and the wellbore.

In one example, a completion string or other downhole apparatus on which the expandable apparatus is mounted may be used to inject a flow of fluid into the wellbore for the purpose of suspending particulate matter therein. As such, a flow port may be located on the completion string/downhole apparatus for this purpose.

The retractable sleeve may facilitate the circulation of a flow of fluid towards the surface of the wellbore. The retractable sleeve may prevent or restrict a flow of fluid through the apertures in the base pipe. The retractable sleeve may prevent or restrict a flow of fluid through the plurality of apertures in the base pipe when in the first (non-retracted) configuration. In preventing or restricting a flow of fluid through the plurality of apertures, the retractable sleeve may direct the flow of fluid elsewhere for the purpose of circulation of a flow of fluid, for example towards and through the flow port of the expandable apparatus. In restricting or preventing a flow of fluid through the plurality of apertures, the retractable sleeve may assist circulation of a flow of fluid downhole through the flow channel of the expandable apparatus and into the wellbore, and uphole via an annulus between the expandable apparatus and the wellbore. In the first configuration, the retractable sleeve may therefore prevent or restrict flow of a fluid from the annulus and back into the expandable apparatus via the plurality of apertures.

Fluid flow through the expandable foam material may be prevented or restricted when the expandable foam material is in the non-expanded configuration. As such, when the retractable sleeve is in the first configuration and is retaining the expandable foam material in the non-expanded configuration, flow of a fluid through the plurality of apertures may be restricted or prevented by the expandable foam material, which may act to block a flow of fluid therethrough. Additionally or alternatively, a sealing arrangement (e.g. a sealing element or a plurality of sealing elements) may be provided between the retractable sleeve and the base pipe, which may prevent a flow of fluid through the plurality of apertures when the retractable sleeve is in the first configuration. For example, the sealing arrangement may isolate, or assist to isolate, the plurality of apertures on the base pipe from fluid communication with the wellbore, thereby preventing or restricting a flow of fluid therethrough.

The expandable foam material may be mounted on the base pipe so as to fully circumscribe the base pipe (e.g. a section of the base pipe). As such, the expandable foam material may be suitable to cover a large area of the wellbore, casing etc. when installed therein, and may be useable, for example to prevent the ingress of particulates into the wellbore at more than one location. In the expanded configuration, the expanded foam material may contact an entire circumferential section of an external surface, e.g. of a wellbore, casing etc. The expandable foam material may be directly mounted on the base pipe (for example bonded or adhered to the base pipe). The expandable foam material may be mounted in an annular shape around the base pipe. The expandable foam material may be mounted on the base pipe so as to partially circumscribe the base pipe. For example, a section (e.g. a circumferential and/or axial portion) of the base pipe may be absent of the expandable foam material (e.g. may not comprise any expandable foam material). In this example, only the portions of the base pipe that are known to be located in proximity to a known defect downhole may comprise an expandable foam material.

The expandable foam material may be mounted on the base pipe by any appropriate means, for example by chemical bonding, such as glue, or by mechanical means such as clamping. The expandable foam material may be provided in the form of a sleeve. The sleeve may be glued or clamped (e.g. clamped via end rings) to the base pipe. In this way, the foam may be securely attached to the base pipe, while not having any great effect on the fluid permeability of the foam, and without obstructing the plurality of apertures.

The expandable foam material may be compressible. To configure the expandable foam material to the non-expanded configuration, the expandable foam material may be compressed under the retractable sleeve. The expandable foam material may be provided on the base pipe in an initially compressed configuration. The expandable foam material may be compressed through use of the retractable sleeve to elastically deform the expandable foam material. When the retractable sleeve is in the first configuration, the compressed expandable foam material may be in contact with an interior surface of the sleeve when the sleeve is in the first configuration, such that the expandable foam material is held in the non-expanded configuration by the retractable sleeve. The free portion of the expandable foam material may be provided upon movement of the retractable sleeve towards the second configuration, such that the free portion of the expandable material is no longer in contact with the retractable sleeve. The free portion may be configured from the non-expanded configuration to the expanded configuration by virtue of an elastic recovery effect. The material properties of the expandable foam material may assist to configure the expandable foam material from the non-expanded to the expanded configuration. Elastic recovery may be an inherent property of the expandable foam material. For example, where the expandable foam material is elastically deformed by the retractable sleeve in the first configuration, movement of the retractable sleeve towards the second configuration alone may permit expansion of the foam material (e.g. expansion of the free portion of the expandable foam material), as a result of the removal of the cause of the elastic deformation of the expandable foam material. In this scenario, the expandable foam material may expand without any further external stimulant.

In one example, the expandable foam material may increase in volume when expanded (e.g. when configured from the non-expanded configuration to the expanded configuration). The expandable foam material may increase in volume when configured to the expanded configuration to the extent that the expandable foam material comes into contact with an external surface in the wellbore. The expansion of the expandable foam material in the expanded configuration may be limited by an external surface in the wellbore (e.g. a surface of a sand screen, or a surface of an open or unlined wellbore). The expandable foam material may be expanded (e.g. configured to the expanded configuration) so as to be compliant with an external surface (e.g. a surface of a sand screen, or a surface of a wellbore). For example, various portions of the wellbore may expand by differing amounts depending on the geometry of an external surface. In doing so, the area of contact between the expandable foam material and the wellbore may be maximised.

The expandable foam material may require a stimulant to be configured between the non-expanded configuration and the expanded configuration, e.g. from the non-expanded configuration to the expanded configuration. For example, the expandable foam material may require interaction with a fluid (e.g. water) in order to be configured between the non-expanded configuration and the expanded configuration. In one example, the expandable foam material may be mounted on the base pipe in a non-expanded configuration, and stimulated in a wellbore such that it is in the expanded configuration. In such a configuration, a user may have increased control of the expansion of the expandable foam material in the wellbore.

In one example, the expandable foam material may comprise a swellable material. A swellable material may be integrated into the expandable foam material. The expandable foam material may comprise a layer of swellable material integrated therein. The swellable material may swell upon contact with a stimulant. For example, the swellable material may swell upon contact with water and/or hydrocarbons (such as oil). The swellable material may assist to expand the expandable foam material. For example, the swellable material may swell upon contact with a stimulant, so as to cause the expandable foam material to expand.

The expandable foam material may be or comprise an open-cell foam material. Such an open cell foam material may assist to permit the flow of a fluid therethrough, while preventing the flow of particulate matter suspended in said fluid flow, thereby assisting the filtration effect of the foam.

The expandable foam material may comprise a swellable material in a cell of the open-cell foam material (e.g. some or all cells of the open-cell foam material).

The expandable foam material may be made from any appropriate type of foam. For example, the expandable foam material may be made from polyurethane foam, for example polyurethane reticulated foam such as polyurethane reticulated foam 60 PPI (pores per inch).

The coarseness of the expandable foam material may be selected depending on the size of particulates the expandable foam material is intended to exclude from a flow of fluid. The coarseness of the expandable foam material may be in pores per inch (PPI) or pores per millimetre, with a coarser foam material having fewer pores per inch than a finer foam material. The expandable foam material may be of a uniform, or substantially uniform coarseness throughout its entirety.

The expandable foam material may have a varying coarseness. For example, the expandable foam material may comprise a section or portion of reduced coarseness, for example a section of the expandable foam material may be finer than the surrounding expandable foam material. A finer expandable foam material may be that having cells of a smaller volume than a coarser expandable foam material, or in other words a higher number of pores per millimetre or PPI. Having an expandable foam material of varying coarseness may assist the expandable foam material to provide more efficient filtration of particulates from a fluid.

The expandable foam material may have a graduated coarseness. For example, one portion of the expandable foam material may be relatively coarse, while another portion of the expandable foam material may be relatively fine. The expandable foam material intermediate the relatively course portion and relatively fine portion may be of graduated coarseness, e.g. may be finer closer to the relatively finer portion and gradually increase in coarseness towards the relatively coarser portion. The coarseness of the expandable foam material may vary in the radial direction.

The expandable foam material may be constructed as a single piece of expandable foam material. Alternatively, the expandable foam material may be constructed of more than once piece of expandable foam material, which may be attached together, for example by bonding.

The expandable foam material may be provided in a single layer, for example having a single coarseness or varying coarseness. Alternatively, the expandable foam material may be provided in a plurality of layers of expandable foam material (which may be bonded and/or secured together, for example). The expandable foam material may be provided as a plurality of sleeves, or parts thereof. For example, the expandable foam material may be provided as a plurality of concentric sleeves, which may be arranged to form a plurality of cylindrical layers. Each of the plurality of layers may have a similar (e.g. the same) coarseness, or may have differing degrees of coarseness (e.g. a varying coarseness). At least one (or some or all) of the plurality of layers may have a graduated coarseness. The variation in coarseness may be radial, circumferential, or both. The variation in coarseness may be axial.

The expandable foam material may comprise a radially inner portion which is finer than a radially outer portion of the expandable foam material. For example, the entire inner annular surface of the expandable foam material may be of a finer foam material than a radially outer portion of the expandable foam material. The expandable foam material may comprise a radially outer portion which is finer than a radially inner portion of the expandable foam material. For example, the entire outer surface of the expandable foam material may be of a finer foam material than a radially inner portion of the expandable foam material. The expandable foam material may comprise a radially inner portion and a radially outer portion, both of which are finer than an intermediate portion of the expandable foam material. For example, the entire inner and outer surfaces (e.g. a portion of the expandable material forming the inner surface and outer surface) of the expandable foam material may be of a finer expandable foam material than an intermediate portion of the expandable foam material, which may be of a coarser foam material.

The coarseness of the expandable foam material may be selected depending on the specific requirements of the expandable foam material. For example, it may be desirable that the expandable foam material provides a graded filtration effect.

Where the expandable foam material comprises a finer expandable foam material and a coarser expandable foam material, the transition between the coarser and finer material may be abrupt (i.e. a sudden change from the finer to the coarser expandable foam material). In some example, the transition between the finer and coarser expandable foam material may be gradual.

The axial length of the expandable foam material may be selected by a user, prior to installation of the expandable apparatus in the wellbore.

The retractable sleeve may be axially moveable between the first configuration and the second configuration (e.g. from the first configuration to the second configuration). The retractable sleeve may be circumferentially moveable (e.g. rotatable) between the first configuration and the second configuration (e.g. from the first configuration to the second configuration). The retractable sleeve may be moveable both in an axial and circumferential direction, for example moveable in a helical direction or motion. The movement of the retractable sleeve may facilitate the movement (e.g. retraction) of the retractable sleeve from the first configuration to the second configuration or vice versa, while minimising disturbance to the expandable foam material.

The retractable sleeve may be or comprise a single sleeve member. The retractable sleeve may be or comprise at least two sleeve members. In one example, the retractable sleeve may be or comprise at least two sleeve members, at least two of the sleeve members being circumferentially moveable relative to each other. Circumferential and/or axial movement of one sleeve member relative to another sleeve member may provide a free portion of the expandable foam material (e.g. a portion of the expandable foam material that is not retained by the retractable sleeve), thereby configuring the retractable sleeve from the first configuration to the second configuration.

The retractable sleeve may be detachable from the expandable apparatus (e.g. fully separable from the expandable apparatus). Retracting the retractable sleeve to configure the expandable apparatus between the first configuration and the second configuration may comprise detachment of the retractable sleeve from the expandable apparatus. Detachment of the retractable sleeve from the apparatus may be by axial movement of the retractable sleeve relative to the expandable apparatus. Once the retractable sleeve has been detached from the expandable apparatus, the retractable sleeve may be able to be removed from the wellbore.

The expandable apparatus may comprise an anchor. The anchor may assist to position the expandable foam material downhole. The anchor may be in the form of a conventional slip arrangement. The anchor may be radially expandable. The anchor may comprise a retracted position and an expanded position. In the retracted position, the anchor may be radially aligned with an outer surface of the expandable apparatus. As such, the expandable apparatus may be able to be run into the wellbore without interference from the anchor. In the expanded position, the anchor may radially expand, such that it protrudes from an outer surface of the expandable apparatus. In the expanded position, the anchor may engage an exterior surface, for example a surface of a sand screen, casing, pipe, rock or formation surface, or any other surface of the wellbore. In the expanded position, the anchor may provide a reaction point for the expandable apparatus, so as to hold the expandable apparatus in place upon the application of a force on the expandable apparatus. For example, movement of the retractable sleeve between the first and second configuration may require the expandable apparatus to provide a reaction force, thereby enabling movement of the retractable sleeve relative thereto. The provision of such a reaction force may be as a result of the engagement of the anchor and an external surface.

The anchor may have a bias towards the expanded position. Where the anchor is biased towards the expanded position, a retaining member (e.g. a moveable sleeve) may retain the anchor in the retracted position until anchoring of the expandable apparatus is required. Once anchoring of the expandable apparatus is required, the retaining member may be removed, such that the anchor moves to the expanded position, and engages a surface in the wellbore to anchor the expandable apparatus in the wellbore. Such an anchor may permit the apparatus to be operated simply, and with a sleeve, the movement of which may additionally facilitate other functions of the apparatus.

The anchor may be moved between the retracted position and the expanded position by an external actuator. For example, an actuator such as a ball, a dart or the like may be dropped and/or flowed into the expandable apparatus to move the apparatus between the retracted position and the expanded position. The expandable apparatus may comprise a catcher for catching the actuator. The catcher may move (e.g. move axially) when the actuator is caught in the apparatus. Axial movement of the catcher may configure the anchor between the retracted configuration and the expanded configuration. Axial movement of the catcher may cause a compressive force to act on the anchor, thereby configuring the anchor between the expanded and the retracted configuration.

The anchor may comprise an engagement surface or portion for engagement of a surface external to the expandable apparatus. The engagement surface or portion may comprise a toothed profile to facilitate engagement with a surface.

The anchor may comprise a non-return mechanism. The non-return mechanism may be in the form of a ratchet. The non-return mechanism may assist prevent movement of the anchor from the expanded position to the retracted position.

The expandable apparatus may comprise a centraliser. The centraliser may be located on the expandable apparatus axially uphole of the expandable foam material. Alternatively or additionally, the expandable apparatus may comprise a centraliser located axially downhole of the expandable apparatus. The centraliser may assist to centre the apparatus once the apparatus has the desired position in the wellbore. The centraliser may be configurable between a retracted position, in which it does not provide a centralising effect, and an extended position, in which a centralising effect is provided.

The centraliser may be located radially inwards (e.g. underneath) of the retractable sleeve when in the retracted position. Retracting the retractable sleeve may enable configuration of the centraliser from the retracted position to the extended position. The centraliser may comprise a bow spring. The bow spring may be compressed under the retractable sleeve, prior to retraction of the retractable sleeve, when the centraliser is in the retracted position. Upon retraction of the retractable sleeve, the bow spring may naturally move to the extended position. In the extended position, the bow spring of the centraliser may radially extend from an outer surface of the expandable apparatus, so as to contact and/or engage a surface of the wellbore, thereby centralising the expandable apparatus in the wellbore.

A plurality of the expandable apparatuses may be stackable in a wellbore.

The expandable apparatus may comprise a connection profile at an upper and/or lower end thereof, to facilitate the stacking of a first apparatus with a second apparatus. A plurality of apparatuses may be able to be stacked in a wellbore, for example, two, three, four, five etc. apparatuses. Stacking of apparatuses may enable a user to have a degree of control over the axial length of expandable foam material that is installed in a wellbore.

The stacked apparatuses may be identical. Alternatively, at least one of the stacked apparatuses may comprise at least one different component to another of the stacked apparatuses. For example, only one stacked apparatus may require to have an inlet and outlet port for the introduction and removal of a fluid from a wellbore (e.g. only the apparatus located furthest downhole may require an inlet and outlet port). In such a situation, the remainder of the apparatuses may not comprise such a feature.

The expandable apparatus may be installed as a retrofit apparatus in a wellbore. The apparatus may be for repair of a defect, for example a defect such as a fissure or hole in a casing, sand screen, pipe, or the like in the wellbore. In this case, a retrofit apparatus may be useful, as the location of such defects may be random and unpredictable.

The expandable apparatus may be installed as part of a completion string. The apparatus may comprise a completion string connection profile at an upper and/or lower end thereof, to facilitate installation of the apparatus with a completion string. Having the apparatus installable as part of a completion string may enable a user greater flexibility in terms of the size the expandable foam material able to be located on the expandable apparatus, than may be possible if the apparatus were to be a retrofit apparatus, for example due to size restrictions when running a retrofit apparatus into a wellbore, e.g. due to a lubricator stack.

The expandable apparatus may comprise or be used in combination with a pump. The pump may assist to flow a fluid through the base pipe of the expandable apparatus. In use, the pump may assist to flow a fluid being produced from an adjacent formation through the base pipe. For example, the pump may assist to flow water being produced from an adjacent formation through the base pipe. The pumping of a fluid through the base pipe may encourage production of a gas from an adjacent formation. Such a gas may permeate the expandable foam material of the expandable apparatus, such that the gas occupies an annulus surrounding the base pipe of the expandable apparatus. The pump may encourage the flow of only a liquid (e.g. water) through the base pipe. A gas, for example a produced gas, may remain in an annulus surrounding the expandable apparatus, and be flowed towards surface by other means.

The pump may be located at a region of the expandable apparatus downhole of the expandable foam material. As such, a produced fluid (e.g. a produced liquid) may flow through the expandable foam material and in a downhole directions towards the pump. Due to the lower density of a produced gas, the produced gas may naturally flow through the expandable foam material and in an upward direction in an annulus surrounding the base pipe. As a produced fluid flows through the expandable foam material, it may naturally separate into a lighter gas fraction and a denser liquid fraction, while solid particulate matter that is held in the liquid is held in the expandable foam material. As such, a gas may emerge from the uphole end (or the end which is oriented to have a higher elevation) of the expandable foam material, whereas a liquid may emerge from the downhole end (or the end which is oriented to have a lower elevation) of the expandable foam material. As such, having the pump located below the expandable foam material may encourage a separation of a produced liquid from a produced gas, as the produced liquid will naturally flow towards the pump under gravity, whereas the produced gas will naturally flow away from the pump.

The expandable apparatus may be for use in correcting a defect in a sand screen. The expandable apparatus may be for use in plugging a fracture in a sand screen. In use, the expandable foam material may make direct contact with a sand screen, when the expandable foam material is in the expanded configuration.

The expandable apparatus may be for use in preventing ingress of shale into a wellbore. The expandable apparatus may be for use in preventing ingress of shale into a wellbore during methane production, for example methane contained in a seam of coal (coal bed methane). In use, the expandable foam material may make direct contact with a subsurface formation when the expandable foam material is in the expanded configuration. The expandable foam material may make direct contact with a layer of shale. Alternatively, the expandable foam material may make direct contact with a casing or liner that runs through a subsurface formation. The expandable foam material may assist to prevent ingress of shale into a wellbore, while permitting the flow of a liquid (e.g. water) and/or a gas (e.g. methane) into the wellbore. The expandable foam material may have a stabilising effect of a subsurface formation. For example the direct contact between the expandable foam material and a subsurface formation may have a stabilising effect on the subsurface formation. The expandable foam material may have a stabilising effect on a layer of shale in a subsurface formation. The expandable foam material may stabilise a subsurface formation by limiting the volume of particulate matter being produced by the subsurface formation (e.g. the volume of particulate matter exiting the subsurface formation in a flow of fluid such as production fluid).

An aspect of the present disclosure relates to a method for restricting ingress of solids in a wellbore, comprising:

positioning the downhole expandable apparatus in a wellbore;

retracting a retractable sleeve of the downhole expandable apparatus to provide a free portion of expandable foam material, mounted on the downhole expandable apparatus, to radially expand towards an expanded configuration and into engagement with a surface in the wellbore.

The method may comprise anchoring the expandable apparatus in a wellbore. The method may comprise anchoring the expandable apparatus to a casing, sand screen, pipe, or the like within a wellbore.

The method may comprise retracting the retractable sleeve from a first configuration in which the retractable sleeve retains the expandable foam material in a non-expanded configuration, towards a second configuration in which the retractable sleeve is retracted to provide a free portion of the expandable foam material, permitted to radially expand towards the expanded configuration and into engagement with a surface in the wellbore.

The method may comprise anchoring the expandable apparatus in a wellbore before retracting the retractable sleeve from the first configuration to the second configuration.

The method may comprise axially retracting the retractable sleeve from the first configuration to the second configuration. The method may comprise removing the retractable sleeve from the apparatus (e.g. detaching the retractable sleeve from the apparatus).

An aspect of the present disclosure relates to a method for repairing/plugging a defect in a sand screen or tubular, comprising:

positioning a downhole expandable apparatus in a wellbore adjacent a defect, the expandable apparatus comprising a base pipe and an expandable foam material mounted thereon, the expandable foam material being retained in a non-expanded configuration by a retractable sleeve;

retracting the retractable sleeve of the downhole expandable apparatus to configure a portion of the expandable foam material to an expanded configuration, in which the expandable foam material is expanded so as to contact the defect.

An aspect of the present disclosure relates to a method for stabilising a subsurface formation, comprising:

positioning a downhole expandable downhole apparatus in a wellbore adjacent a subsurface formation, the expandable apparatus comprising a base pipe and an expandable foam material mounted thereon, the expandable foam material being retained in a non-expended configuration by a retractable sleeve;

retracting the retractable sleeve of the downhole apparatus to configure a portion of the expandable foam material to an expanded configuration, in which the expandable foam material is expanded so as to contact the subsurface formation.

An aspect of the present disclosure relates to a downhole filtration apparatus for restricting ingress of solids in a wellbore, comprising:

a base pipe;

a filtration assembly comprising a fluid permeable expandable foam material mounted on the base pipe, said foam material being configurable between a non-expanded and an expanded configuration; and a retractable sleeve moveable between a first configuration in which the retractable sleeve retains the expandable foam material in the non-expanded configuration, and a second configuration in which the retractable sleeve is retracted to provide a free portion of the expandable foam material, permitted to radially expand towards the expanded configuration and into engagement with a surface in the wellbore.

DETAILED DESCRIPTION OF THE DRAWINGS

The present disclosure relates to an expandable apparatus in which an expandable foam material may be caused to expand so as to restrict the ingress of solids in a wellbore. The expandable apparatus may be defined as a filtration apparatus. The expandable apparatus may have multiple exemplary uses, some of which are described below.

Figure 1:
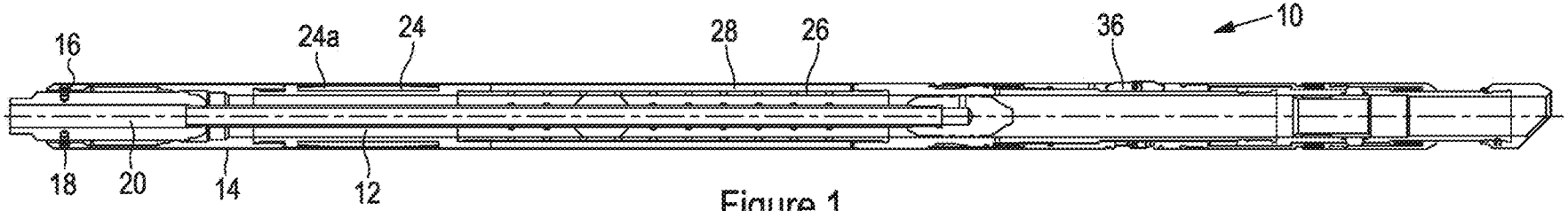
FIG. 1 is a cross-sectional view of an expandable apparatus.

An example of an expandable apparatus 10 is shown in FIG. 1. The expandable apparatus 10 is constructed of a plurality of parts, described below, that together define a base pipe. The expandable apparatus 10 defines a flow channel 12 that extends axially along the length of the expandable apparatus 10.

The expandable apparatus 10 is shown surrounded by a retractable sleeve 14, which in this example completely circumscribes the expandable apparatus 10. The retractable sleeve 14 terminates at an uphole end of the expandable apparatus 10 in a sleeve connector 16. In use, the sleeve connector 16 may be moved axially uphole relative to the expandable apparatus 10 so as to retract the retractable sleeve 14 from the expandable apparatus 10, as will be shown in the following Figures. In the example of FIG. 1, the sleeve connector 16 is connected, to tool 20, which may be a actuator tool (and the actuator tool may also be a running tool). As a result of the connection between the sleeve connector 16 and the actuator tool 20, movement of the actuator component in an axially uphole direction results in a similar axial uphole movement of the retractable sleeve 14, thereby removing the retractable sleeve 14 from the expandable apparatus 10.

Figure 2:
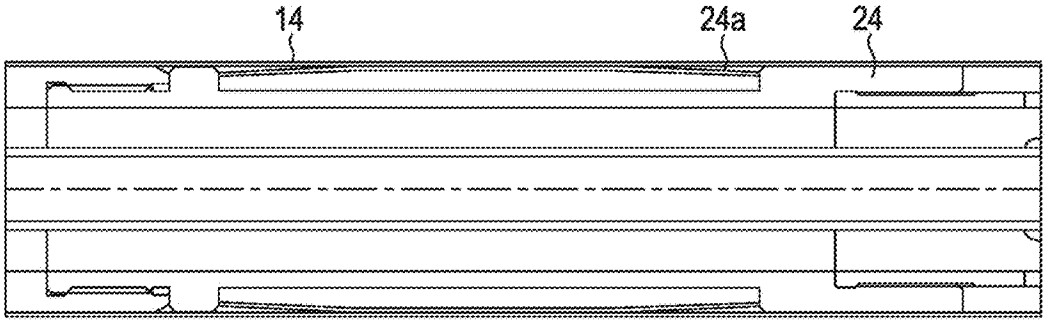
FIG. 2 is an enlarged view of region 2 of FIG. 1.

Axially downhole, the apparatus 10 further comprises a centraliser 24, further detail of which can be seen in FIG. 2. The centraliser comprises a bow spring 24*a* which, in the example of FIG. 1, is held in a retracted position under the retractable sleeve 14. In the retracted position, the centraliser 24 is prevented from any engagement with an external surface by the retractable sleeve 14.

Figure 3:
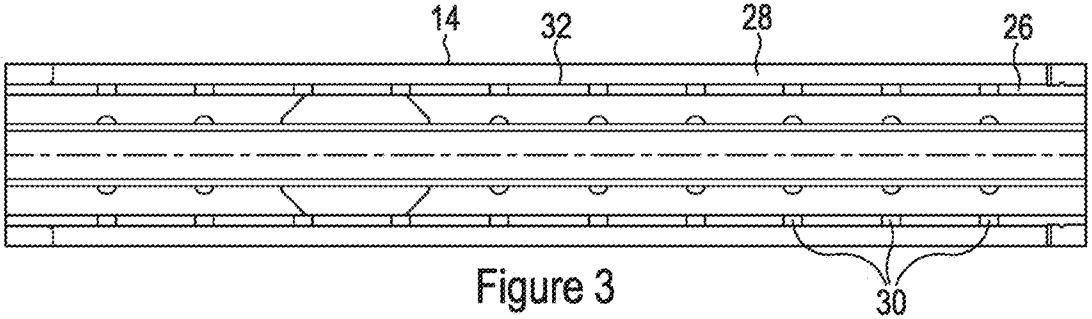
FIG. 3 is an enlarged view of region 3 of FIG. 1.

The apparatus further comprises a base pipe 26 having an expandable foam material 28 mounted thereon, more detail of which can be seen in FIG. 3. In this example, the base pipe 26 comprises a plurality of apertures 30, axially and circumferentially spaced along the base pipe 26 such that, in use, a fluid is able to flow into or out of the plurality of apertures 30. The expandable foam material 28 is mounted on an outer surface 32 of the base pipe 26. Although it is not shown in detail in FIG. 3, the skilled person will appreciate that the expandable foam material 28 may be mounted on the base pipe 26 by any suitable means, for example by chemical bonding e.g. through application of an adhesive. The expandable foam material is contained within an annulus formed between the retractable sleeve 14 and the base pipe 26, and in the example of FIGS. 1 and 3, the expandable foam material 28 is pressed against an inner surface of the retractable sleeve 14, which functions to hold the expandable foam material 28 in the non-expanded configuration. It should be noted that the expandable foam material 28 is mounted on the base pipe 26 such that it traverses each of the plurality of apertures 30 therein. As such, were a fluid containing particulate matter to be flowed through the expandable foam material 28, then the particulate matter would be prevented from entering the interior of the base pipe 26 by the expandable foam material 28, while the fluid portion (which may be a liquid, or a gas, or both) would be permitted to flow through the expandable foam material 28 and the plurality of apertures 30, and into the interior of the base pipe 26. In the example shown, the expandable foam material 28 is shown as a single sleeve surrounding the base pipe 26. It should, however, be noted that the expandable foam material 28 may be provided as multiple concentric sleeves. For example, the expandable foam material 28 may be provided as a first sleeve mounted on the base pipe, and a concentric second sleeve mounted on the first sleeve, the second sleeve being of greater diameter than the first sleeve. As such, the expandable foam material 28 may be provided on the base pipe 26 in the form of multiple cylindrical layers.

With the centraliser 24 in the retracted position and the expandable foam material 28 in the non-expanded configuration, FIGS. 1 to 3 illustrate the expandable apparatus 10 configured so as to enable running and positioning of the expandable apparatus 10 downhole.

Figure 4:
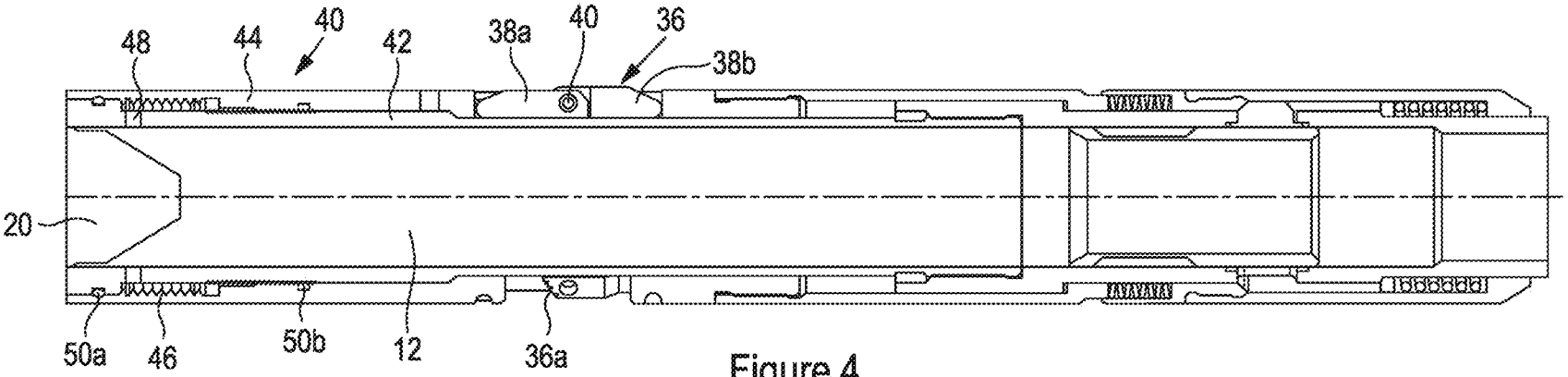
FIG. 4 is an enlarged view of region 4 of FIG. 1.

Forming part of the expandable apparatus 10 is an anchor 36, more detail of which can be seen in FIG. 4. Shown in FIGS. 1 and 4, the anchor 36 is in a retracted position to facilitate running of the expandable apparatus 10 into a wellbore (not shown). The anchor 36 is configurable to an expanded position, shown in the following figures, which may permit the expandable apparatus 10 to engage an external surface (e.g. the inner surface of a casing, sand screen, pipe, or the like, in which the expandable apparatus 10 is positioned). To better grip an exterior surface, the anchor 36 is provided with a toothed profile 36*a*, as can be seen in FIG. 4. In the example shown in FIGS. 1 and 4, the anchor 36 is formed from a plurality of elongate members, arranged in pairs 38*a*, 38*b*. A view of one such pair 38*a*, 38*b* is shown most clearly in FIG. 4. As shown, each of the elongate members 38*a*, 38*b* is connected by a pin member 40, enabling rotation of a first elongate member 38*a* relative to a second elongate member 38*b*. In the retracted position, as shown in FIG. 4, the pair of elongate members 38*a*, 38*b* lie flat, such that their radially outer surface is generally in line with the radial outer surface of the surrounding expandable apparatus 10, and each of the axes of the elongate members 38*a*, 38*b* is generally aligned with that of the expandable apparatus 10.

It should be noted that the retractable sleeve 14 does not axially extend as far as the anchor 36, such that the anchor 36 is able to be operated regardless of the position of the retractable sleeve 14.

Axially adjacent and uphole of the anchor 36 is a sliding sleeve mechanism 40, which can be used to operate the anchor 36. The sliding sleeve mechanism 40 comprises an inner sleeve 42 and an outer sleeve 44, with a chamber 46 being located therebetween. A port 48 in the inner sleeve 42 allows fluid communication between the chamber 46 and the flow channel 12 in the interior of the expandable apparatus 10. The anchor 36 is positioned on an outer surface of the inner sleeve 42, while an end portion of the outer sleeve 44 abuts an axially uphole end of the elongate member 38*a* of the anchor 36.

In use, the port 48 may be exposed to a higher fluid pressure, the pressure communication between the port 48 and the chamber 46 also causing the pressure in the chamber 46 to rise. Such an increased pressure may be as a result of an increase in pressure in the flow channel 12 itself, or as a result of a pressure containing tool (e.g. the actuator tool 20) being positioned in pressure communication with the port 48.

A rise in pressure in the chamber 46 will cause a force to act on seal members 50*a*, 50*b*, positioned between the inner and outer sleeves 42, 44, thereby urging the inner and outer sleeves 42, 44 in opposing directions. In this example, the outer sleeve 44 is permitted to move in an axially downhole direction, relative to the inner sleeve 42. As the outer sleeve 44 is urged in a downhole direction, an axially directed force acts on the anchor 36. This causes rotation of the elongate members 38*a*, 38*b* relative to the pin 40, such that the elongate members form a V-shape that protrudes radially from the surface of the expandable apparatus 10 (best shown in FIGS. 8 and 9).

Figure 5:
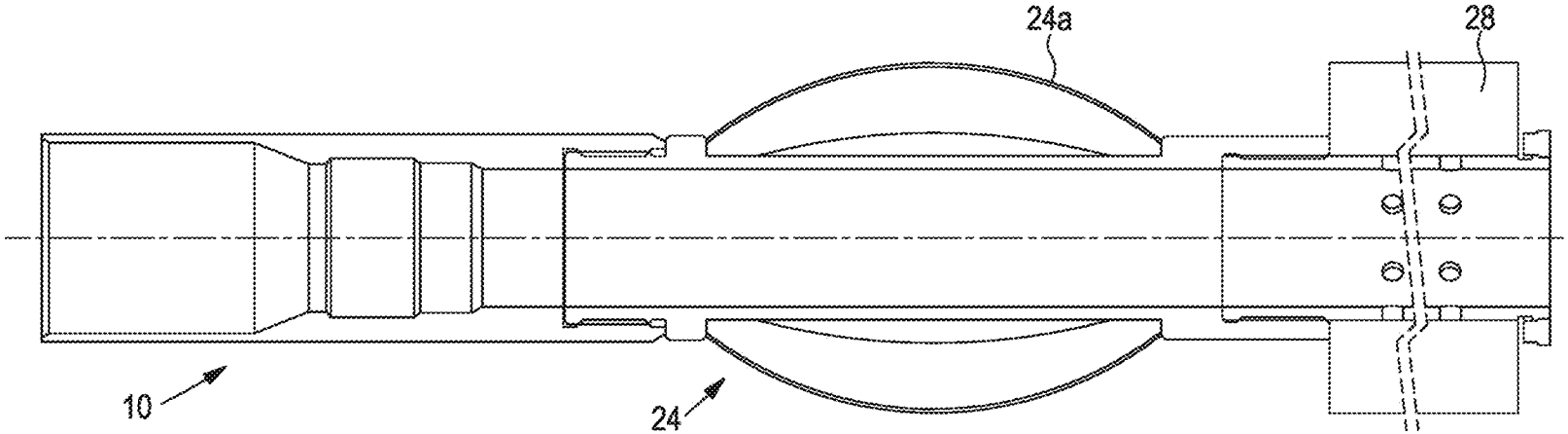
FIG. 5 illustrates the expanded configuration of the apparatus of FIG. 1.

In FIG. 5 is shown an elevation view of an uphole section of the expandable apparatus 10, with the retractable sleeve (not shown) removed. As shown, with the retractable sleeve removed, the bow spring 24*a* of the centraliser 24 has sprung radially outwardly, such that, when positioned in a wellbore (not shown), the centraliser 24 would contact a surface of the wellbore to centre the expandable apparatus 10 therein.

Similarly, following the removal of the retractable sleeve, the expandable foam material 28 has expanded radially. In situ, the expandable foam material 28 would continue to expand until coming into contact with a surface in a wellbore. The expansion may be by a variety of mechanisms, for example by an elastic recovery effect of the foam material, following removal of radially inwardly directed compressive force applied by the retractable sleeve on the expandable foam material 28, or as a result of the exposed expandable foam material 28 being free to interact with wellbore fluids, thereby expanding the foam material 28.

FIGS. 6 to 9 illustrate one example of the installation of the expandable apparatus 10 of FIG. 1 in a wellbore 50.

In this example, a sand screen 52 has been installed in the wellbore 50, and the sand screen has developed a number of faults 54 therein, leading to the ingress of sand 56 into the interior of the sand screen 52. The faults 54 may have been caused by, for example, a hot spot on the sand screen 52, or by erosion of the sand screen 52.

The expandable apparatus 10 is run inside the sand screen 52, and lowered (e.g. on a completion string 58) to the location of the faults 54 in the sand screen. Once at the location of the faults 54, a flow of fluid (water, for example) can be flowed through the flow channel 12 of the apparatus. Although not shown, then apparatus may comprise a nozzle arrangement, such that the fluid exits the flow channel 12 of the expandable apparatus 10 as a jet, thereby assisting to cause rapid and turbulent flow inside the sand screen. Such flow may assist to entrain the sand that has been deposited inside the sand screen in the fluid. As the fluid is flowed into the sand screen, the tool may be moved in a downhole direction, as can be seen in FIGS. 6 and 7, entraining sand within the fluid flow as it is moved.

Figure 7:
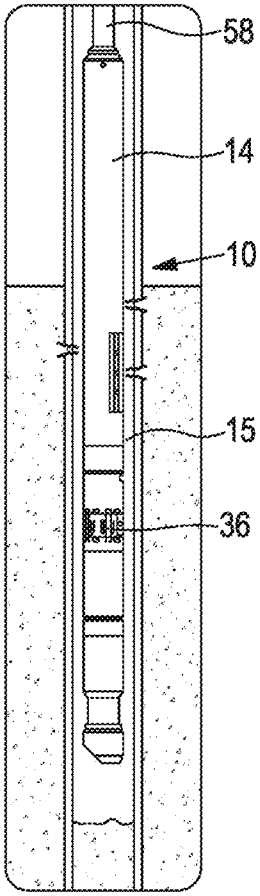
Figure 6:
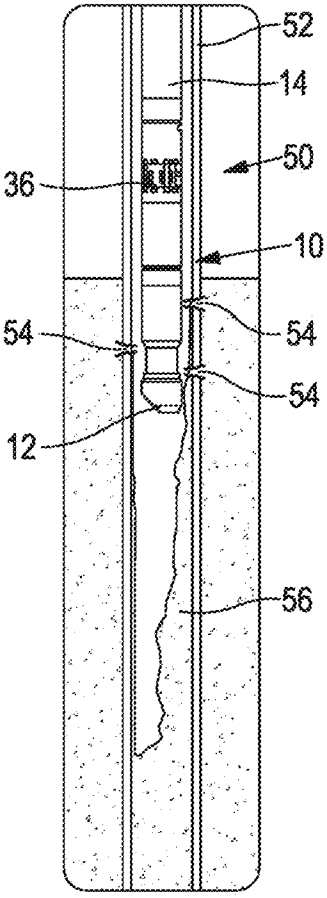

As can be seen in FIGS. 6 and 7, the retractable sleeve 14 is in the retracted configuration whereby the expandable foam material (not visible in FIGS. 6 and 7) is held thereunder. In this configuration, fluid flow through the apertures in the base pipe 26 is prevented by the retractable sleeve 14. Therefore, flow of a fluid through the flow channel 12 exits through the nozzle arrangement (not shown) and into an annulus 15 between the apparatus 10 and the sand screen 52. Once in the annulus, the flow of fluid can be used to suspend particulate matter therein, and be circulated to the surface via the annulus 15.

Once the sand has been cleared from the interior of the sand screen, the expandable apparatus 10 is positioned such that the expandable foam material 28 is positioned radially adjacent the faults 54 in the sand screen 52. Initially, the expandable foam material is contained beneath the retractable sleeve 14, and is not in contact with the sand screen 52. The retractable sleeve 14 is then axially retracted from the tool (as shown in FIGS. 8 and 9) to expose the expandable foam material 28.

However, before the retractable sleeve 14 may be retracted, the expandable apparatus 10 must be secured in position in the wellbore. To secure the apparatus 10 in the wellbore, an anchor 36 is moved from a retracted position to an expanded position, as described previously. In the expanded position, the anchor 36 protrudes radially so as to engage the sand screen 52. Once engaged with the sand screen 52, the anchor prevents axial movement of the expandable apparatus 12 in the wellbore 50.

Thereafter, the completion string 58 is able to be detached from the uphole end of the expandable apparatus 10, although maintaining a connection with the retractable sleeve 14. As axial movement of the expandable apparatus 10 is now prevented by the engagement of the anchor 36 with the sand screen, then uphole axial movement of the completion string 58 with the connected retractable sleeve 14 will have the effect of axially retracting the retractable sleeve 14 from the expandable apparatus 10.

Figure 9:
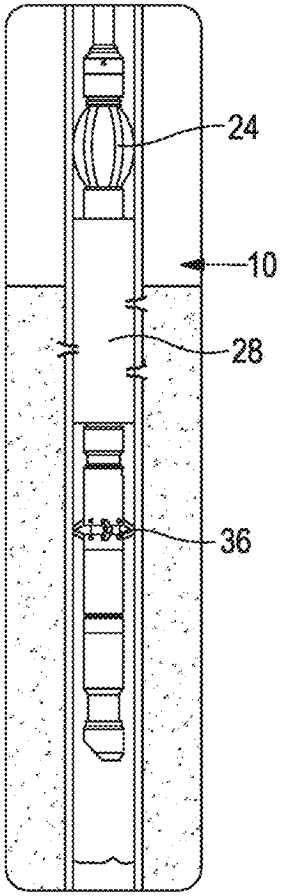
FIGS. 6 to 9 show a sequence of steps of an installation of the apparatus of FIG. 1.
Figure 8:
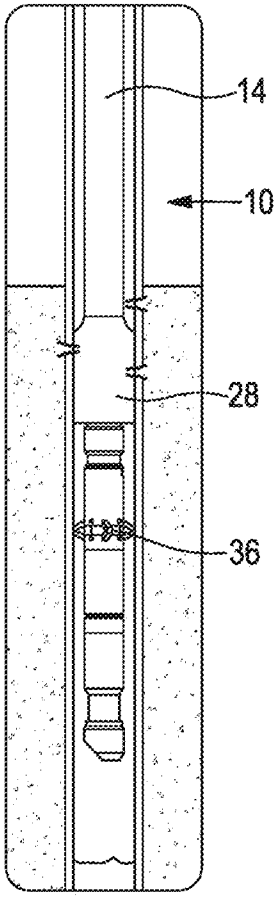

As can be best seen in FIGS. 8 and 9, as the retractable sleeve is retracted from the expandable apparatus 10, the expandable foam material 28 expands radially outwardly, and into contact with the sand screen 52 so as to bridge the faults 54 therein. Similarly, a centraliser 24, located on a section of the expandable apparatus 12 that is uphole of the expandable foam material 28, radially expands from a retracted position to an extended positon, contacting an interior surface of the sand screen 52 and providing a centralising effect on the expandable apparatus 10.

Once in place the expandable foam material 28 of the expandable apparatus 10 bridges the faults 54 in the sand screen 52 so as to prevent ingress of sand therein, while continuing to permit the flow of a fluid therethrough. Once installed, the expandable apparatus 10 may remain in position for as long as production of a fluid into the sand screen is desired.

Figure 10:
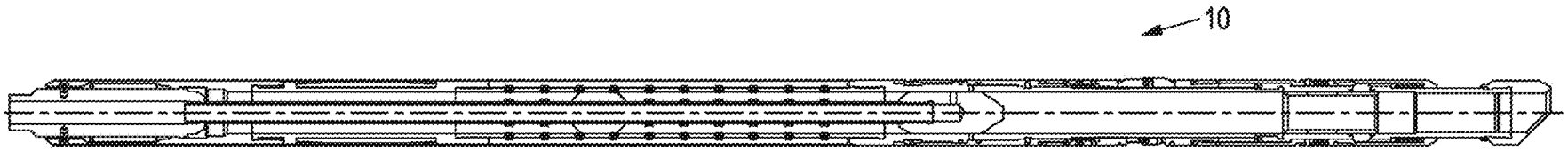
FIGS. 10 and 11 show detail of a further example of the expandable apparatus.
Figure 11:
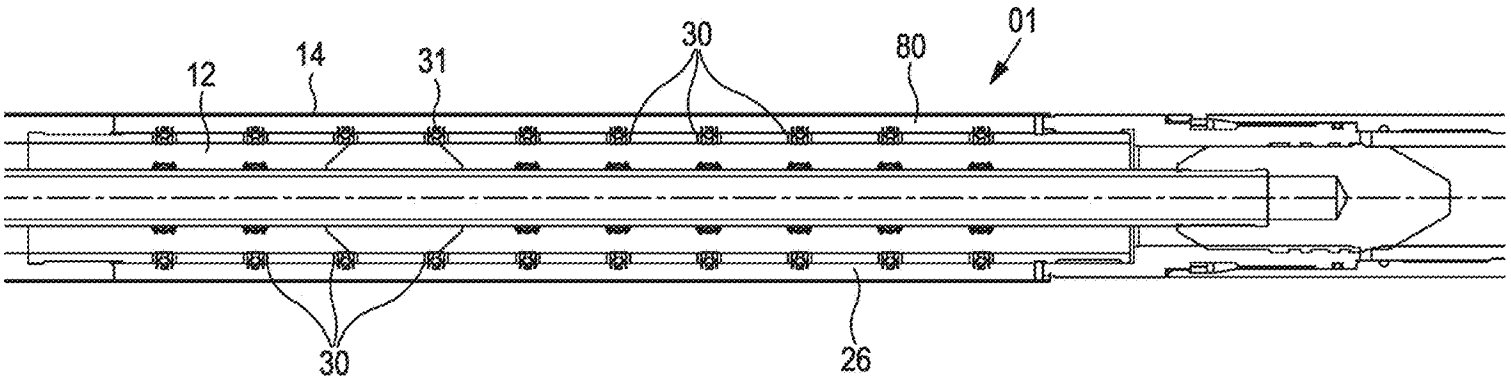

FIGS. 10 and 11 illustrate a further example of an expandable apparatus 10, having a valve incorporated into the apertures 30 of the base pipe 26.

For the sake of conciseness, a description of identical parts of the expandable apparatus 10 to those in FIGS. 1 to 5 will not be repeated. In this example, the expandable apparatus 10 comprises a base pipe 26 comprising a plurality of apertures 30, with an expandable foam material 28 mounted thereon so as to fill an annulus between the base pipe 26 and a retractable sleeve 14. Each of the plurality of apertures comprises a check valve 31, which permits the flow of a fluid in a radially outward direction. As with the example of FIGS. 1 to 5, the expandable foam material 28 bridges each of the plurality of apertures 30.

In this example, a fluid may be flowed through a fluid channel 12 of the expandable apparatus, and through the check valves 31 provided in the base pipe 26. The flow of fluid may then pass through the expandable foam material 28 and into a wellbore. As such, in this example, the expandable apparatus may be used to inject fluid into a wellbore, whilst simultaneously providing a plugging effect of a crack, aperture, fissure, or the like in a sand screen, tubing, pipeline etc. in a wellbore, so as to prevent ingress of particulate material therein (for example, during breaks in the injection of a fluid into a wellbore).

Figure 12:
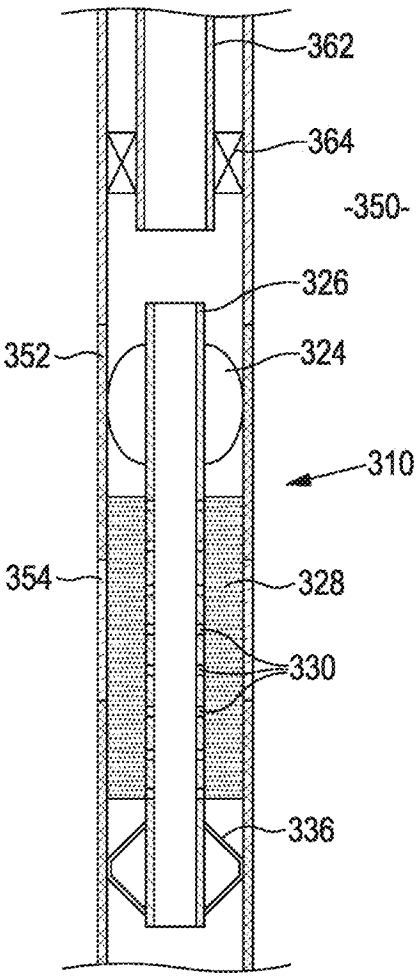
FIG. 12 is a schematic illustration of an exemplary expandable apparatus installed downhole.

FIG. 12 is a schematic diagram of through-tubing 362 with an expandable apparatus 310 installed in a sand screen 352 in a wellbore 350. Schematically illustrated, the apparatus 310 essentially comprises a base pipe 326 having a plurality of apertures therein 330. An expandable foam material 328 is mounted on the base pipe 326, and bridges each of the plurality of apertures 330. An anchor 336 is positioned below the expandable foam material 328, and is used to hold the expandable apparatus 310 in place relative to the sand screen 352, as in previous examples. Similarly, a centraliser 324 is provided uphole of the expandable foam material 328 to centralise the expandable apparatus 310 in the wellbore 350. In this example, the expandable foam material 328 bridges a large defect 354 in the sand screen 352. Uphole of the expandable apparatus 310 is a through-tubing 362, held in position by packers 364, which may be used for receiving a fluid produced in through the sand screen 352 in the wellbore, or may be used to provide an injection fluid to the expandable apparatus 310.

With the retractable sleeve (not shown) in the retracted configuration, the expandable apparatus 310 is of a diameter that it is able to be installed via through-tubing 362, and subsequently expanded and installed against the sand screen 352.

Figure 13:
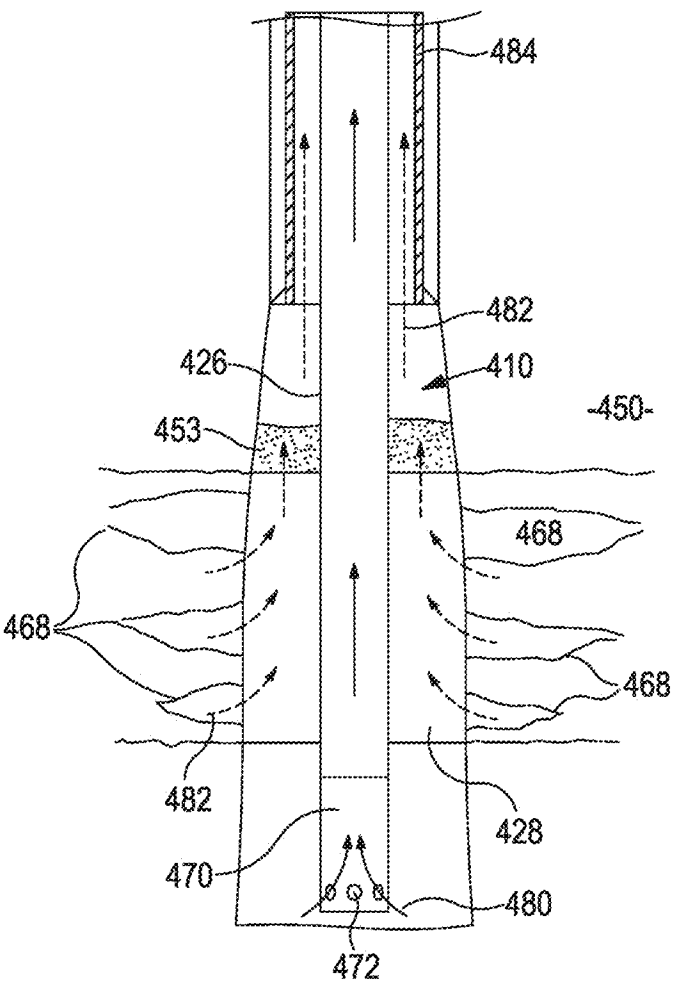
FIG. 13 is a schematic illustration of a further exemplary expandable apparatus installed downhole.

FIG. 13 illustrates a further use of an example of an expandable apparatus 410. In this example, the expandable apparatus 410 is positioned in an open hole wellbore 450, radially adjacent a shale formation containing seams of coal 468, the seams of coal being impregnated with methane gas. The example shown in FIG. 13 contains some similarities to that described in FIGS. 1 to 5. As such similar reference numerals have been used for similar parts, augmented by 400.

In contrast to the previous examples, wherein the expandable apparatus is run in to a wellbore having an existing sand screen in place, in this example the expandable apparatus 410 may form part of a completion string that is run into and installed in an open-hole section of wellbore, for example before initial production operations in the wellbore begin. In this example the expandable apparatus 410 may be run into a wellbore on a tooling string, and maintain a connection with said tooling string throughout production in the wellbore.

As can be seen in FIG. 13, and as was the case with previous examples, the apparatus 410 comprises a base pipe 426, having an expandable material 428 mounted thereon. It should be noted that, in this example, the base pipe is simply a blank pipe, and does not comprise any apertures, as was the case with the previous examples. In this case, the length of the expandable material is selected so as to be approximately the same depth as the shale formation, adjacent to which the expandable apparatus 410 is positioned. As such, when the expandable foam material 428 is in the expanded configuration as shown, it expands so as to be in contact with the surrounding shale formation 450 along substantially the entire depth of the shale formation 450.

In a further example, it may be possible to stack multiple apparatuses in a wellbore, so as to provide expandable foam material along the entire depth of the shale formation 450. Further, although in the example of FIG. 13 contact between the expandable foam material 428 is shown along the entire depth of the shale formation 450, examples where there are gaps in the contact between the expandable foam material and the shale formation 450 are equally possible. For example, as long as expandable foam material is present at the top and bottom of the shale formation 450, so as to contain particulate matter in the shale formation 450, the apparatus may be able to function.

While, in this example, it may be possible to secure the expandable apparatus 410 in place with an anchor (not shown), as in the previous examples, as the expandable apparatus 410 maintains a connection with the tooling string, an anchor may not be necessary. Instead, the expandable apparatus 410 may be held in place by the tooling string, the tooling string being held in place by any appropriate means, for example by packers.

In this example, the expandable apparatus 410 comprises a pump 470 located axially downhole of the expandable foam material 428.

In use, the expandable apparatus 410 is positioned adjacent the shale formation with a retractable sleeve (not shown in this example) positioned over the expandable foam material 428, with the expandable foam material 428 being in the non-expanded configuration. As with previous examples, once in the desired position, the retractable sleeve is retracted and the expandable foam material 428 expanded to be in contact with the surrounding shale formation 450.

After the retractable sleeve has been retracted, the pump 470 can be operated to pump any fluid in the wellbore through an inlet 472, and through a flow channel in the base pipe (not shown) towards the surface of the wellbore. Typically, shale formations may produce large volumes of fluid, e.g. water. Where seams of coal are included in the shale formation, methane gas may also be produced, along with large quantities of shale rock. Having the expandable foam material 428 of the expandable apparatus 410 in contact with the shale formation may prevent or reduce the production of shale from the formation, while permitting the production of fluids, for example water and/or methane. As such, the expandable foam material 428 may assist to stabilise subsurface formations, such as shale formations, which may otherwise release particulate matter into the wellbore.

Reducing the production of particulate matter (e.g. shale) from the formation may be beneficial for the operation of pump 472. In particular, where there is intermittent operation of pump 472, particulate matter (such as shale) may settle on the pump while it is not in use. Such large volumes of shale can make it difficult to restart the pump 472 without cause significant damage. Therefore the apparatus may prolong the lifespan of the pump 472, as it may reduce the choking of the pump by produced particulate matter.

With the pump 472 in operation, liquids (e.g. water) from the formation 450 may flow through the expandable foam material 428 and proceed in a downhole direction, towards pump 472 in the direction of arrows 480, through the flow channel of the expandable apparatus 410 and towards the surface of the wellbore. As the liquids are produced, gas (e.g. methane) may also be produced. By virtue of its lighter density, the produced gas will tend to flow upwards in the direction of arrows 482, and will remain in an annulus between the expandable apparatus 410 and the wellbore 450. For illustrative purposes, the produced gas is shown exiting the expandable foam material 428 in the form of bubbles 453 exiting from the upwardly located surface of the expandable foam material 428.

Uphole of the expandable apparatus 410 is located a section of casing 484, which can be used to collect the produced gas in the annulus.

The invention claimed is:

1. A downhole expandable apparatus for restricting ingress of solids in a wellbore, comprising:

a base pipe, the base pipe comprising at least one aperture in a wall thereof;

a fluid permeable expandable foam material mounted on the base pipe configurable between a non-expanded and an expanded configuration, the at least one aperture being positioned on a section of the base pipe that is under the expandable foam material mounted on the base pipe, such that the expandable foam material extends across the at least one aperture; and a retractable sleeve moveable between a first configuration in which the retractable sleeve retains the expandable foam material in the non-expanded configuration, and a second configuration in which the retractable sleeve is retracted to provide a free portion of the expandable foam material to permit the expandable foam material to radially expand towards the expanded configuration and into engagement with a surface in the wellbore.

2. The downhole expandable apparatus according to claim 1, wherein the fluid permeable expandable foam material at least partially defines a filtration assembly.

3. The downhole expandable apparatus according to claim 1, comprising a flow channel extending axially along the apparatus.

4. The downhole expandable apparatus according to claim 1, wherein the base pipe comprises a plurality of apertures, and the plurality of apertures are substantially evenly spaced along the base pipe.

5. The downhole expandable apparatus according to claim 1, wherein the at least one aperture comprises a valve therein.

6. The downhole expandable apparatus according to claim 1, comprising a flow port for the introduction and/or removal of a fluid from the wellbore.

7. The downhole expandable apparatus according to claim 1, wherein the retractable sleeve prevents or restricts a flow of fluid through the at least one aperture in the base pipe when the retractable sleeve is in the first configuration.

8. The downhole expandable apparatus according to claim 1, wherein fluid flow through the expandable foam material is prevented or restricted when the expandable foam material is in the non-expanded configuration.

9. The downhole expandable apparatus according to claim 1, wherein the expandable foam material is mounted on the base pipe so as to fully circumscribe the base pipe.

10. The downhole expandable apparatus according to claim 1, wherein the expandable foam material is configured to the non-expanded configuration by compression under the retractable sleeve when the retractable sleeve is in a first position.

11. The downhole expandable apparatus according to claim 1, wherein the expandable foam material comprises an open-cell foam material.

12. The downhole expandable apparatus according to claim 1, wherein the expandable foam material has a varying coarseness.

13. The downhole expandable apparatus according to claim 12, wherein the expandable foam material has a graduated coarseness from a relatively coarse portion of expandable foam material, to a relatively fine portion of expandable foam material.

14. The downhole expandable apparatus according to claim 1, wherein the expandable foam material is provided in a single layer.

15. The downhole expandable apparatus according to claim 1, wherein the retractable sleeve is axially moveable between the first configuration and the second configuration.

16. The downhole expandable apparatus according to claim 1, wherein the retractable sleeve is detachable from the expandable apparatus.

17. The downhole expandable apparatus according to claim 1, comprising a pump located downhole of the expandable foam material.

18. A method for restricting ingress of solids in a wellbore, comprising:

positioning the downhole expandable apparatus of claim 1;

retracting the retractable sleeve to provide a free portion of expandable foam material mounted on the downhole expandable apparatus, and permit the free portion of expandable foam material to radially expand towards an expanded configuration and into engagement with a surface in the wellbore.

19. A method for repairing/plugging a defect in a sand screen or tubular, comprising:

positioning a downhole expandable apparatus in a wellbore adjacent a defect, the expandable apparatus comprising a base pipe, wherein the base pipe comprises at least one aperture in a wall thereof, and a fluid permeable expandable foam material mounted thereon, wherein the at least one aperture is positioned on a section of the base pipe that is under the expandable foam material mounted on the base pipe such that the expandable foam material extends across the at least one aperture, the expandable foam material being retained in a non-expanded configuration by a retractable sleeve;

retracting the retractable sleeve of the downhole expandable apparatus to configure a portion of the expandable foam material to an expanded configuration, in which the expandable foam material is expanded so as to contact the defect.

20. A method for stabilising a subsurface formation, comprising:

positioning a downhole expandable downhole apparatus in a wellbore adjacent a subsurface formation, the expandable apparatus comprising a base pipe, wherein the base pipe comprises at least one aperture in a wall thereof, and a fluid permeable expandable foam material mounted thereon, wherein the at least one aperture is positioned on a section of the base pipe that is under the expandable foam material mounted on the base pipe such that the expandable foam material extends across the at least one aperture, the expandable foam material being retained in a non-expended configuration by a retractable sleeve;

retracting the retractable sleeve of the downhole expandable apparatus to configure a portion of the expandable foam material to an expanded configuration, in which the expandable foam material is expanded so as to contact the subsurface formation.

* * * * *